US005622192A

United States Patent [19]

Chiou

[11] Patent Number: 5,622,192

[45] Date of Patent: Apr. 22, 1997

[54] COMB HAVING SPRAYING AND MASSAGING DEVICES

[76] Inventor: Shih-Kuen Chiou, No. 584, Sec. 2, Chung-San Rd., Hwu-Lian Village, Yeong-Jing Shiang, Changhua Shiann, Taiwan

[21] Appl. No.: 567,703

[22] Filed: Dec. 5, 1995

[51] Int. Cl.[6] ..... A45D 24/22

[52] U.S. Cl. ..... 132/112; 132/115; 132/116; 132/119.1; 132/113; 222/192; 222/509; 15/22.1

[58] Field of Search ..... 401/283, 28, 180, 401/188, 16, 279; 15/22.1; 132/112, 111, 110, 113, 115, 116, 119.1, 147, 212; 222/192, 509; 119/604, 608, 609, 665

[56] References Cited

U.S. PATENT DOCUMENTS

| | | | |
|---|---|---|---|
| 3,358,309 | 12/1967 | Richardson | 15/22.1 |
| 3,721,250 | 3/1973 | Walter et al. | 132/112 |
| 3,964,501 | 6/1976 | Matchett | 132/112 |
| 4,964,398 | 10/1990 | Jones | 15/22.1 |
| 5,297,512 | 3/1994 | Sharp | 132/119.1 |

*Primary Examiner*—Gene Mancene
*Assistant Examiner*—Pedro Philogene
*Attorney, Agent, or Firm*—Browdy and Neimark

[57] ABSTRACT

A comb comprises a head, a combing portion, a spraying device, a massaging device, and a head shield fastened with the head. The combing portion is fastened with the underside of the head and is provided with a plurality of combing teeth. The spraying device comprises a container for holding therein hair spray and a dispensing apparatus for dispensing hair spray. The massaging device comprises a motor, an eccentric cam and batteries. The vibration force of the eccentric cam in motion is transmitted to the combing teeth to provide hair with a massaging effect.

2 Claims, 2 Drawing Sheets

COMB HAVING SPRAYING AND MASSAGING DEVICES

FIELD OF THE INVENTION

The present invention relates generally to a comb, and more particularly to a comb having a built-in spraying device and a built-in massaging device.

BACKGROUND OF THE INVENTION

The conventional comb is a rather handy tool for use in grooming and massaging the hair; nevertheless it is incapable of dispensing the hair spray and of providing an effective massage of the hair.

SUMMARY OF THE INVENTION

It is therefore the primary objective of the present invention to provide a comb with a spraying device and a massaging device.

The foregoing objective of the present invention is attained by a comb, which comprises a head portion, a plurality of teeth fastened securely with the head portion, a spraying device located in the head portion and provided with a hair spray container and a spraying nozzle, and a massaging device located in the head portion and provided with a motor and an eccentric cam driven by the motor to provide the vibration force which is transmitted to the teeth so as to bring about a hair massaging effect.

The foregoing objective, features, functions and advantages of the present invention will be more readily understood upon a thoughtful deliberation of the following detailed description of an embodiment of the present invention in conjunction with the accompanying drawings.

DETAILED DESCRIPTION OF THE INVENTION

Figure 1:
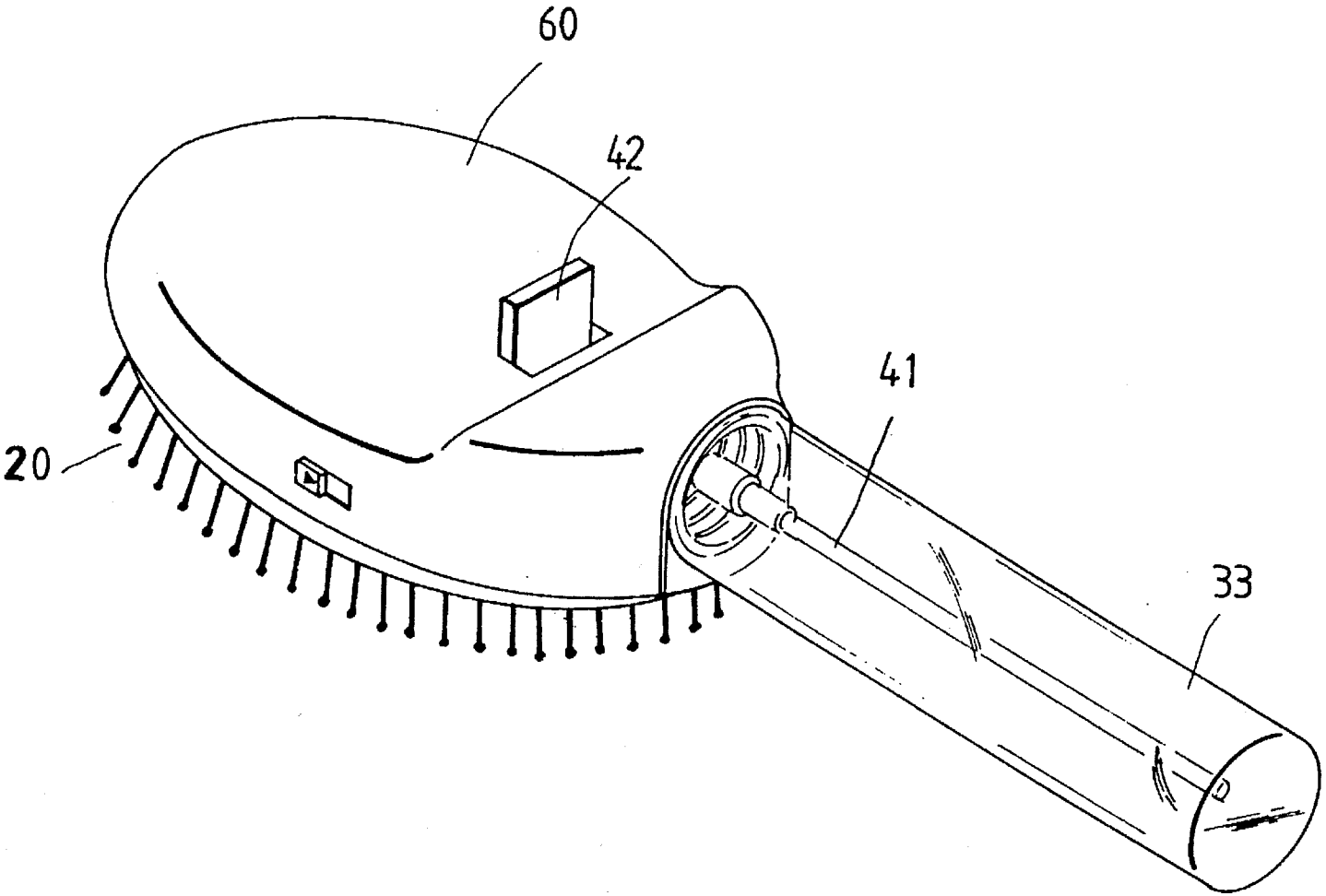
FIG. 1 shows a perspective view of a comb embodied in the present invention.
Figure 3:
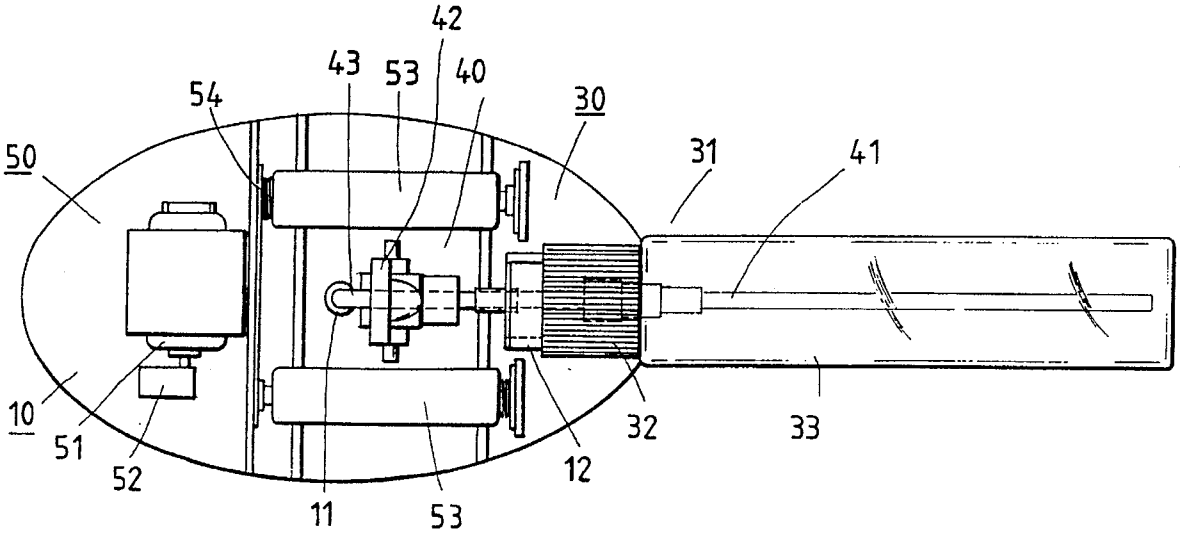
FIG. 3 shows a top sectional view of the comb embodied in the present invention.
Figure 2:
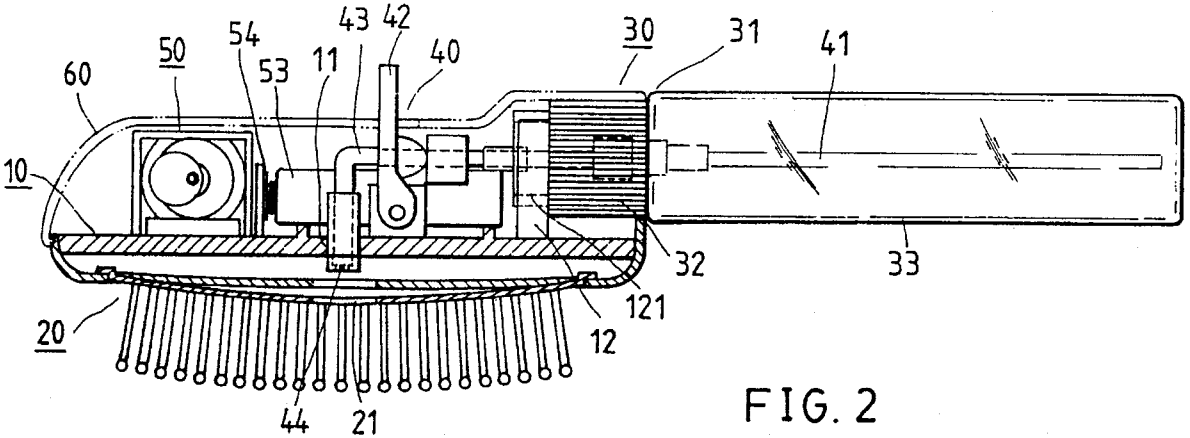
FIG. 2 shows a side sectional view of the comb embodied in the present invention.

As shown in FIGS. 1–3, a comb embodied in the present invention is composed of a head portion 10, a combing portion 20, a spraying device 30, a pumping member 40, a massaging device 50, and a housing 60.

The head portion 10 is of an oval construction and is provided at the center thereof with a through hole 11.

The combing portion 20 is fastened to the underside of the head portion 10 and is provided with a plurality of combing teeth and a hole 21 corresponding in location to the through hole 11 of the head portion 10.

The spraying device 30 is located in the rear portion of the head portion 10 and is composed of a handle 31 comprising a socket 32 and a container 33 of an elongated construction. The container 33 is intended to hold therein the hair spray and is provided at the front end thereof with a male threaded portion of the socket 32. The socket 32 is received at the front end thereof in a receiving hole 121 of a locating block 12.

The pumping member 40 comprises a pumping tube 41 extending into the container 33, a dispensing bar 42 opposite in location to the front end of the pumping tube 41. The bar 42 is capable of compressing so as to draw the liquid hair spray contained in the container 33. The pumping tube 41 is provided at the front end thereof with a guide tube 43 through which the hair spray is transported to a spray nozzle 44, which is in alignment with the through hole 11 of the head portion 10 and the hole 21 of the combing portion 20.

The massaging device 50 is located in the front portion of the head portion 10 and is provided with a motor 51, an eccentric cam 52 mounted on the shaft of the motor 51, and two batteries 53 in contact with a power conduction piece 54 which is in turn in communication with a power conducting piece of the motor 51 via a guide wire (not shown in the drawings).

The housing 60 is used to shield the upper side of the head portion 10 and is provided with a power ON-OFF switch.

In the course of combing the hair with the combing portion 20, the hair spray is emitted via the spray nozzle 44 by pressing the dispensing bar 42. The hairspray container 33 can be so rotated as to become disengaged with the socket 32 to facilitate the replenishing of the hair spray.

As the power switch of the housing 60 is turned on, the motor 51 of the massaging device 50 is started to drive the eccentric cam 52. The vibration force of the eccentric cam 52 in motion is transmitted to the teeth of the combing portion 20 to provide hair with a massaging effect.

The embodiment of the present invention described above is to be regarded in all respects as merely illustrative and not restrictive. Accordingly, the present invention may be embodied in other specific forms without deviating from the spirit thereof. The present invention is therefore to be limited only by the scopes of the following appended claims.

What is claimed is:

1. A comb having spraying and massaging devices, which comprises:

a head portion provided with a through hole and a locating block having a receiving hole;

a combing portion fastened to an underside of said head portion and provided with a plurality of combing teeth and a hole corresponding in location to said through hole of said head portion;

a spraying device disposed in said head portion and composed of a handle having a socket and an elongated container for keeping therein hair spray, with said socket being secured in said receiving hole of said locating block of said head portion;

a pumping member comprising a pumping tube extending into said container of said spraying device, a dispensing bar opposite in location to a front end of said pumping tube, said front end of said pumping tube provided with a guide tube fastened thereto for transporting said hair spray contained in said container to a spray nozzle located in alignment with said through hole of said head portion and said hole of said combing portion;

a massaging device disposed in said head portion and composed of a motor having a shaft, an eccentric cam mounted on said shaft of said motor, and two batteries in communication with said motor by a power conducting means; and a housing fastened to an upper side of said head portion and provided with a power switch controlling the supply of power of said two batteries to said motor.

2. The comb as defined in claim 1, wherein said socket of said handle of said spraying device is provided with a female threaded portion; and wherein said container of said handle of said spraying device is provided at one end thereof with a male threaded portion engageable and disengageable with said female threaded portion of said socket.

* * * * *